US007827707B2

(12) United States Patent
Davis

(10) Patent No.: US 7,827,707 B2
(45) Date of Patent: Nov. 9, 2010

(54) MEMORY FOAM SHOE INSERT

(75) Inventor: Kristene D. Davis, Overland Park, KS (US)

(73) Assignee: KDD Enterprises, Inc., Overland Park, KS (US)

( * ) Notice: Subject to any disclaimer, the term of this patent is extended or adjusted under 35 U.S.C. 154(b) by 1113 days.

(21) Appl. No.: 11/278,793

(22) Filed: Apr. 5, 2006

(65) Prior Publication Data

US 2007/0234595 A1 Oct. 11, 2007

(51) Int. Cl.
*A43B 19/00* (2006.01)

(52) U.S. Cl. ..... 36/71; 36/88; 36/94

(58) Field of Classification Search ..... 36/71, 36/88, 93, 94, 55, 8.1, 95, 97; 128/889, 892, 128/893, 894; 428/40.1, 42.2, 343; 602/41, 602/52; 206/523, 812
See application file for complete search history.

(56) References Cited

U.S. PATENT DOCUMENTS 1,744,122 A * 1/1930 Keeling ..... 36/8.3
2,367,814 A * 1/1945 Whiteford ..... 128/893
2,377,339 A * 6/1945 Greene ..... 2/24
2,670,482 A * 3/1954 Roman ..... 12/128 R
2,810,214 A * 10/1957 Wolfe ..... 36/8.3
2,941,527 A * 6/1960 Scholl ..... 602/30
2,969,062 A * 1/1961 Landau ..... 128/894
3,143,812 A * 8/1964 Ernst ..... 36/44
3,253,591 A * 5/1966 Scholl ..... 128/894
3,260,261 A * 7/1966 Gallovich ..... 128/889
3,325,919 A * 6/1967 Robinson ..... 36/93
3,946,874 A * 3/1976 Breth et al. ..... 206/523
4,026,046 A 5/1977 Clark et al.
4,210,245 A * 7/1980 Dodge ..... 206/440
4,387,516 A 6/1983 Laux
4,428,089 A * 1/1984 Dawber et al. ..... 12/142 R
4,513,518 A 4/1985 Jalbert et al.
4,977,691 A 12/1990 Orchard, 3rd
5,129,165 A 7/1992 Woodle
5,212,894 A 5/1993 Paparo
5,356,372 A * 10/1994 Donovan et al. ..... 602/58
5,740,618 A * 4/1998 Minden ..... 36/8.3
5,791,069 A 8/1998 Oradesky
6,082,027 A * 7/2000 Wagonhurst ..... 36/97
6,092,311 A * 7/2000 MacNamara ..... 36/97

(Continued)

OTHER PUBLICATIONS

Search Report and Written Opinion dated Nov. 14, 2007 as cited in International Application No. PCT/US07/64587; International Filing Date: Mar. 22, 2007; Applicant: KDD Enterprises, Inc.

(Continued)

*Primary Examiner*—Marie Patterson
(74) *Attorney, Agent, or Firm*—Hovey Williams LLP

(57) ABSTRACT

Improved shoe inserts (22, 56, 63) are provided which are designed for placement within the toe regions (37, 52, 64) of shoes (34, 50, 62) to provide enhanced comfort to the shoe wearers. The inserts (22, 56, 63) are preferably cut from initial pillow-shaped bodies (20) to give the custom-designed inserts (22, 56, 63). The inserts (22, 56, 63) are designed to substantially occupy the distal end of the shoe toe region and present a proximal toe-engaging face that substantially spans the cross-sectional dimension of the toe-region. The inserts (22, 56, 63) are preferably formed of heat-sensitive, viscoelastic, polyurethane foam material.

2 Claims, 5 Drawing Sheets

U.S. PATENT DOCUMENTS

| | | | | |
|---|---|---|---|---|
| 6,442,874 | B1 * | 9/2002 | Long | 36/97 |
| 6,519,781 | B1 * | 2/2003 | Berns | 2/267 |
| 6,584,707 | B1 * | 7/2003 | Racine et al. | 36/97 |
| 6,705,026 | B1 * | 3/2004 | Arbour | 36/8.3 |
| 6,746,027 | B1 * | 6/2004 | Soo | 280/11.26 |
| 6,810,603 | B1 * | 11/2004 | Cosentino | 36/8.3 |
| 6,954,997 | B2 * | 10/2005 | Meibock | 36/77 R |
| 7,140,128 | B2 * | 11/2006 | Huckle | 36/54 |
| 7,568,299 | B2 * | 8/2009 | Denha | 36/71 |
| 2003/0172555 | A1 * | 9/2003 | Chu | 36/113 |
| 2005/0034329 | A1 * | 2/2005 | Chen et al. | 36/45 |
| 2005/0115106 | A1 | 6/2005 | Schumacher | |
| 2006/0210751 | A1 * | 9/2006 | Cunningham | 428/40.1 |
| 2007/0107263 | A1 * | 5/2007 | Lopez | 36/71 |
| 2007/0283598 | A1 * | 12/2007 | Gray | 36/93 |

OTHER PUBLICATIONS

International Preliminary Report on Patentability as cited in International Application No. PCT/US07/64587; International Filing Date: Mar. 22, 2007; Applicant: KDD Enterprises, Inc.

* cited by examiner

MEMORY FOAM SHOE INSERT

BACKGROUND OF THE INVENTION

1. Field of the Invention

The present invention is broadly concerned with shoe inserts and methods of use thereof. More particularly, the present invention concerns a shoe insert formed of memory foam and dimensioned to fit within the toe region and be compressed by at least some of the toes of the wearer so as to provide increased shoe comfort. In preferred forms, the insert body is initially of generally quadrate pillow-like form, which can be readily cut or otherwise sized to complement the toe region of desired shoe.

2. Description of the Prior Art

Shoe inserts designed to provide greater comfort during the wearing of shoes have long been provided. Most inserts of this character are formed of resilient foams or gel materials, and are of the full-sole type, meaning that they are placed within a shoe and extend the full length thereof, from toe to heel. However, these types of inserts provide no direct cushioning engagement with the forward surfaces of the wearer's toes, and in effect leave vacant the region between the wearer's toes and the extreme forward toe region of the shoes. This problem is magnified with some women's high-heel shoes having a sharply pointed toe region, such that the toes can experience an extreme amount of pressure.

Children's shoes are also problematic. In particular, children's shoes are often purchased larger than needed so that the child has opportunity to "grow" into the shoes. Oversized shoes are often loose and can cause, among other things, tripping, shuffling, etc.

Specialized shoe inserts have also been provided for dancing slippers or toe shoes, see U.S. Pat. Nos. 4,026,046 and 5,129,165. However, these types of inserts are not principally designed to give shoe comfort, but are used to facilitate toe dancing. For example, the '165 patent describes custom toe caps for ballerina pointe shoes, wherein the inserts are formed of dimensionally stable material affording no floating or distortion of the material during use. Silicone rubber-based compounds are used for this purpose. Similarly, in the '046 patent, a dancing slipper is described having a pre-molded toe insert which is initially shaped by placing the insert in boiling water.

Published Patent Application 2005/0115106 describes a full-length shoe insert used for determining whether a child's foot has outgrown a shoe. The insert is formed of a material (e.g., leather), which is marked by perspiration to show the child's foot placement within the shoe.

Heat-sensitive viscoelastic memory foams were first developed in conjunction with NASA's space programs. Such materials have the ability to conform with human body parts owing to body temperatures and pressure. Memory foams of this type have been adapted for use with beds as mattresses and mattress toppers.

SUMMARY OF THE INVENTION

The present invention provides improved resilient inserts for placement within the toe regions of shoes in order to give enhanced comfort during shoe wear. According to one aspect of the present invention, a shoe and a resilient shoe insert are provided. The shoe includes a sole and a shoe upper, which cooperatively present a substantially enclosed toe region having an open cross-sectional dimension. The insert is located within the toe region and comprises an insert body formed of memory foam. The insert body presents a shape that generally corresponds with a portion of the toe region. The insert body includes a proximal toe-engaging face that substantially spans the cross-sectional dimension, with toe-engaging face being positioned so that the insert body is compressed by at least some of the toes of a wearer of the shoe.

According to another aspect of the present invention, a shoe insert comprises a substantially quadrate body formed of heat-sensitive, viscoelastic polyurethane memory foam. The body has a length of from about two to four inches, a width of from about three-quarter to one and one-half inches, and a maximum thickness of from about one-quarter to three-quarter of an inch. The body is severable to present a preformed and pre-sized insert body adapted to be placed within the toe region of a shoe.

Yet another aspect of the present invention concerns a method of increasing the comfort of a shoe during wearing thereof, wherein the shoe presents a substantially closed toe region having a cross-sectional dimension. The method includes the step of providing a shoe insert body formed of memory foam, with the insert body including a proximal toe-engaging face dimensioned to substantially span the cross-sectional dimension of the toe region. The method also involves the step of placing the insert body within the toe region of the shoe, with the toe-engaging face directed proximally. Additionally, the method involves the step of donning the shoe so that at least some of the toes of the wearer come into contact with the toe-engaging face and compress the insert body.

In order to afford maximum flexibility in use, it is preferred that the insert bodies be initially in the form of small, substantially quadrate bodies having a configuration similar to that of a conventional bed pillow. The bodies are severable by hand scissors or other means in order to give preformed and pre-sized toe insert bodies. Similarly, the preferred use of the inserts involves providing initially quadrate bodies that are cut as necessary to provide inserts for the toes of particular shoes, and the pre-cut insert bodies are placed within the shoe toe regions. The memory foam preferably comprises heat-sensitive, viscoelastic polyurethane. Consequently, when the shoes are donned, the toe inserts are caused to deform under the conditions of temperature and pressure within the shoes so that the insert bodies substantially conform with at least some of the wearer's toes.

Other aspects and advantages of the present invention will be apparent from the following detailed description of the preferred embodiments and the accompanying drawing figures.

BRIEF DESCRIPTION OF THE DRAWINGS

Preferred embodiments of the invention are described in detail below with reference to the attached drawing figures, wherein.

Figure 1:
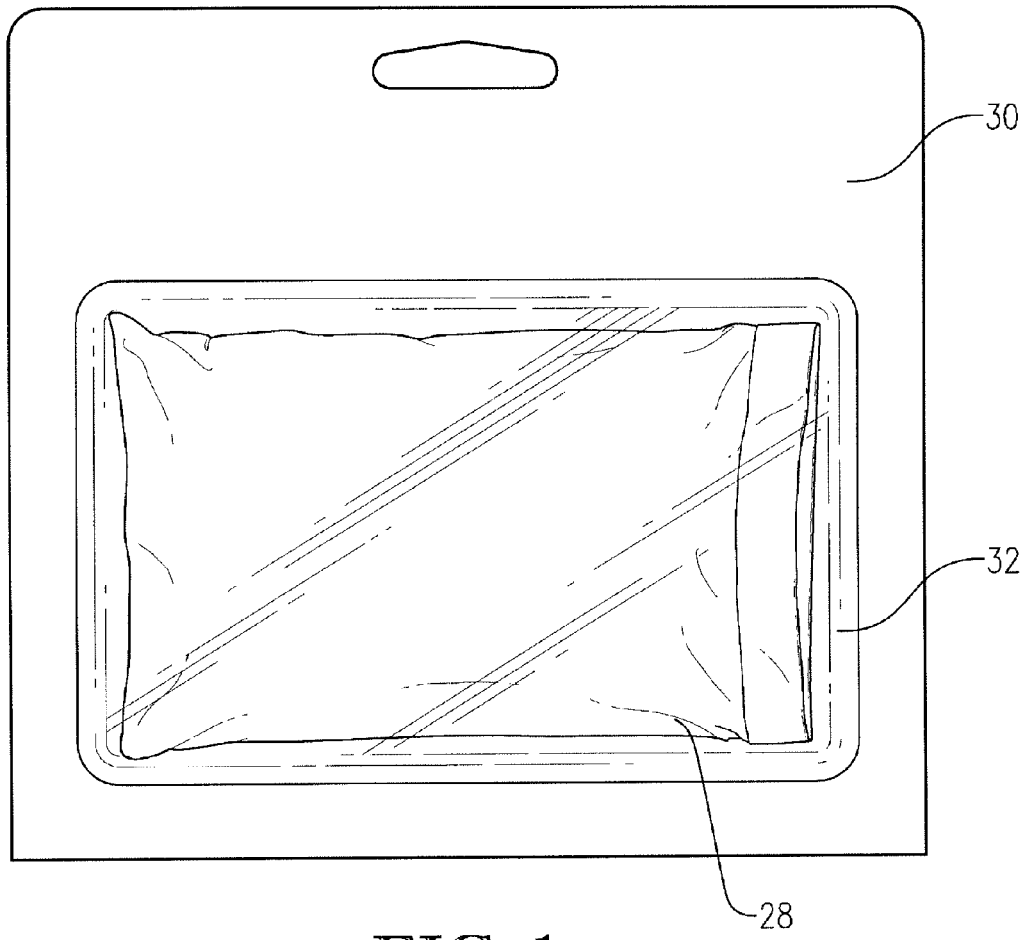
FIG. 1 is a front elevational view of a shoe insert constructed in accordance with a preferred embodiment of the present invention, particularly showing the insert within a retail package before it has been dimensioned for the toe region of a particular shoe.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 6:
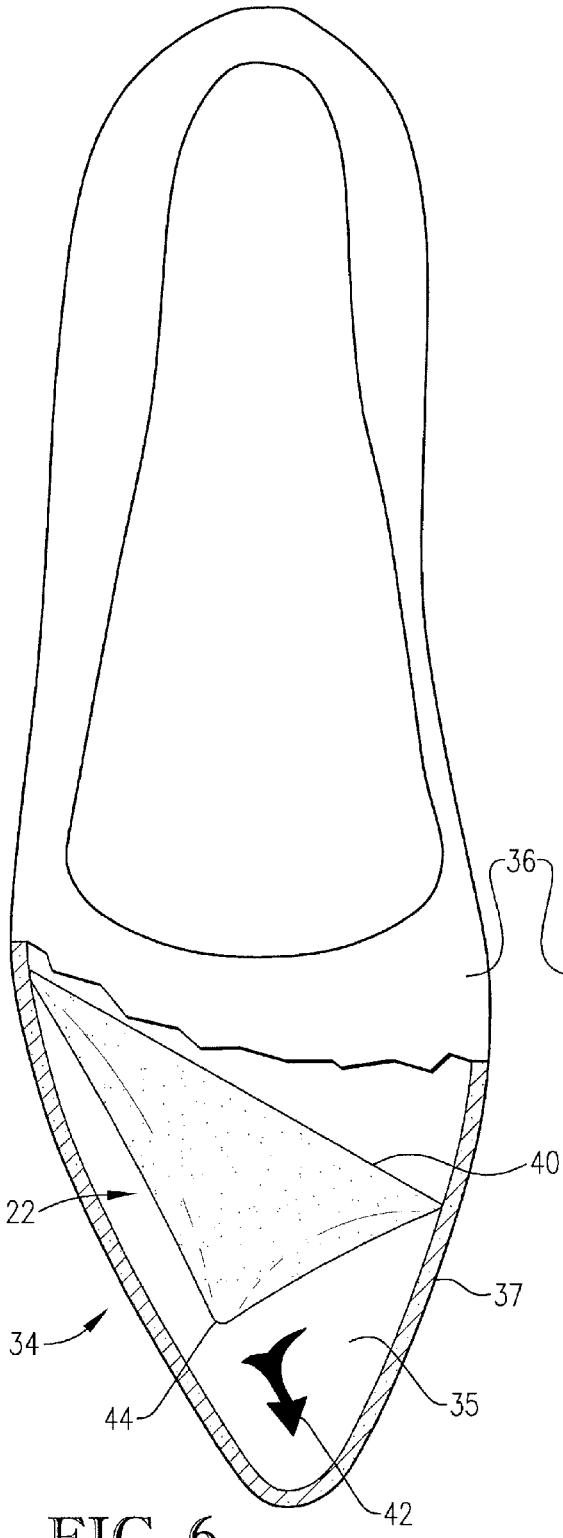
FIG. 6 is a top view in partial vertical section of a woman's shoe, illustrating the placement of the initially cut and shaped insert body.
Figure 7:
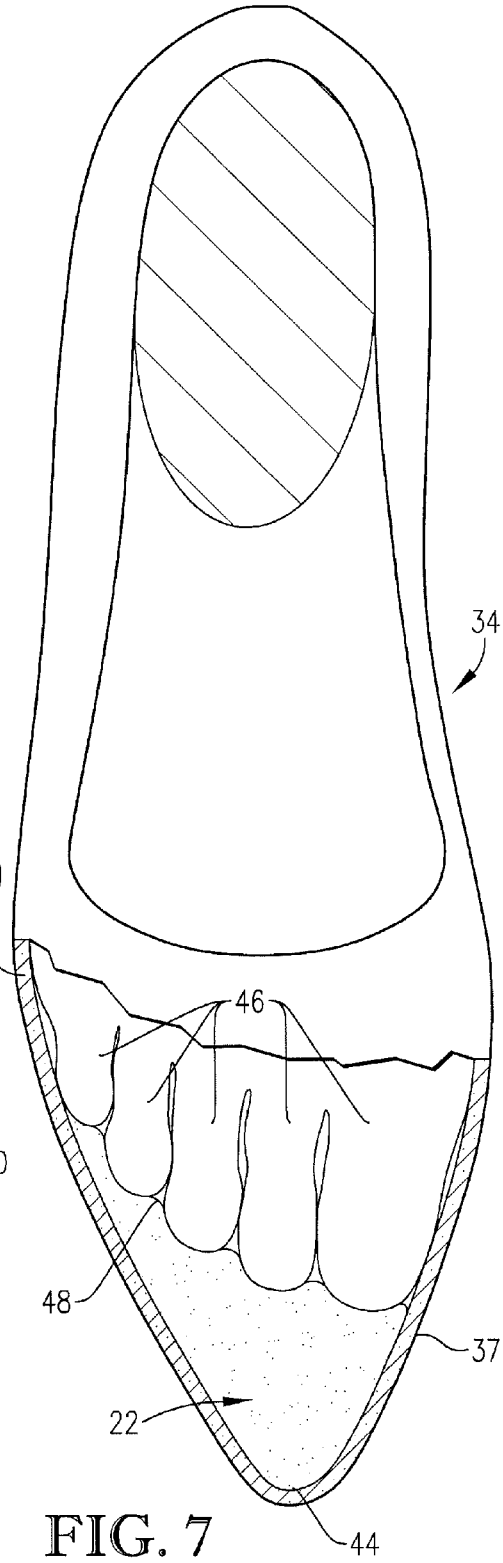
FIG. 7 is a view similar to that of FIG. 6, but showing the insert during use thereof, while the shoe is worn.

Turning now to the drawings, the shoe insert 20 (see FIGS. 1-5) selected for illustrated comprises an initial, generally quadrate body 21, but is designed to be cut or otherwise severed to form a shoe insert body 22 (see FIGS. 6 and 7). In more detail, the initial quadrate body 21 is of substantially rectangular plan configuration, presenting a continuous peripheral edge 24 as well as a rounded, somewhat bulbous mid-section 26. Thus, the body 20 is substantially pillow-shaped in configuration, with an outwardly tapering margin. However, other suitable body shapes and configurations are entirely within the ambit of the present invention (e.g., the body 21 could alternatively have a triangular shape, a purely rectangular non-tapering shape, or the shape of the desired insert body 22).

Figure 2:
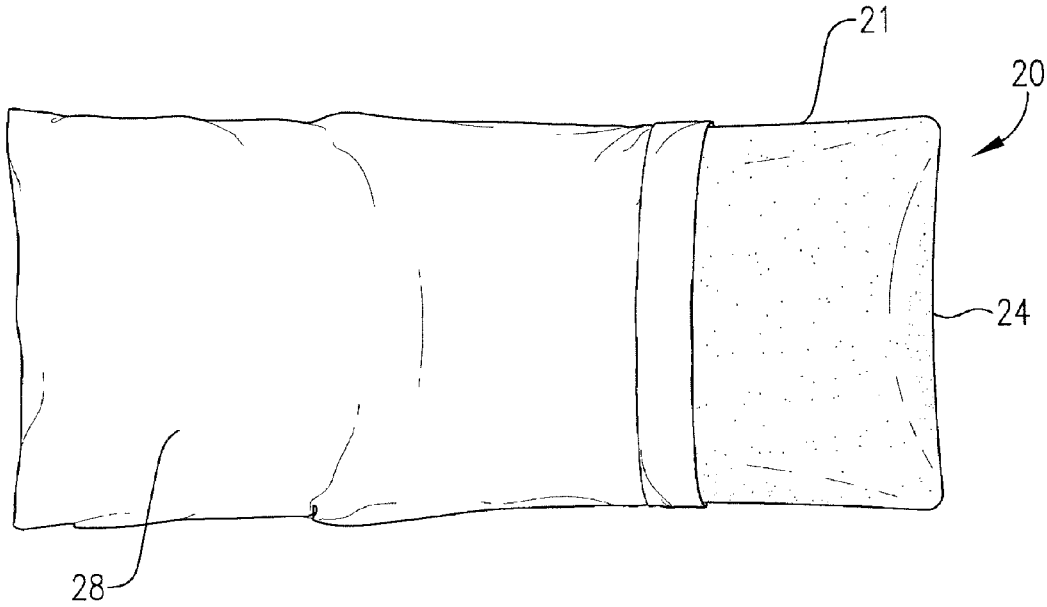
FIG. 2 is an elevational view of the shoe insert as depicted in FIG. 1, with the inner memory foam insert body being shown partly removed from the external separable fabric casing.
Figure 3:
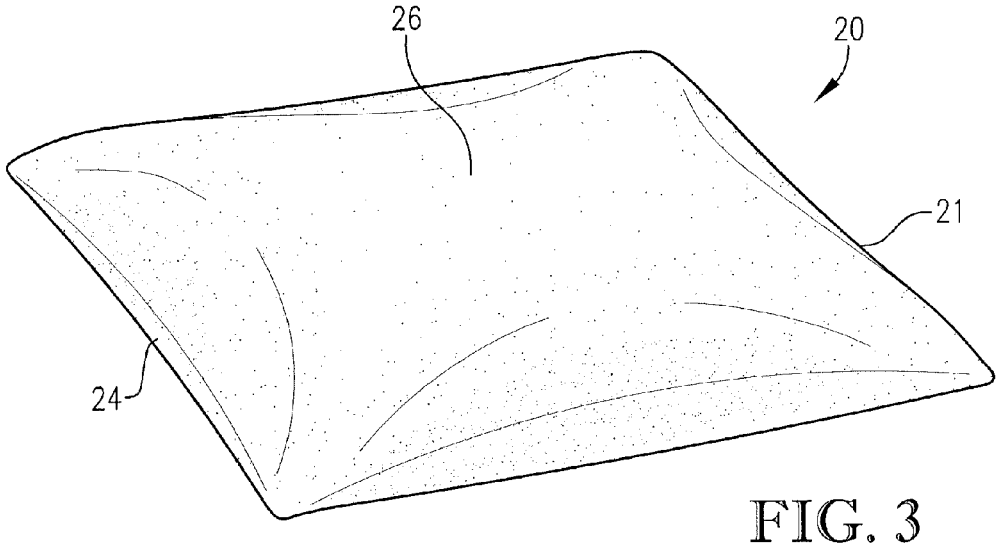
FIG. 3 is a perspective view of a preferred memory foam insert body removed from the casing and prior to dimensioning by the wearer.
Figure 4:
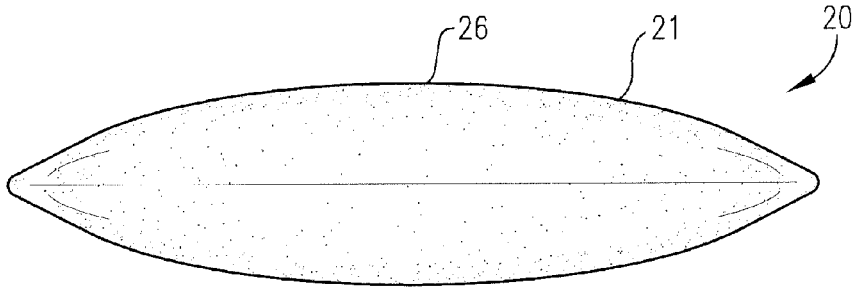
FIG. 4 is a side view of the insert body depicted in FIG. 3.
Figure 5:
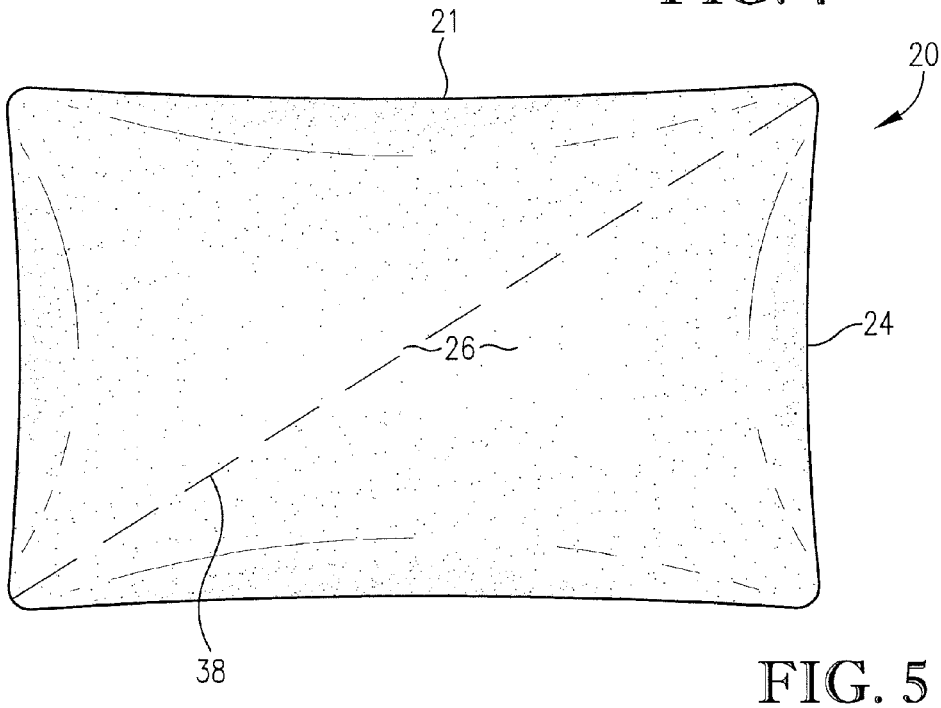
FIG. 5 is a plan view of the insert body depicted in FIGS. 3 and 4, shown with an exemplary diagonally extending cut line for initial cutting and shaping of an insert to be located within a shoe.

In preferred forms, the shoe insert 20, as sold on a retail level, includes an open-ended fabric casing 28 for receiving the initial quadrate body 21 so as to present the appearance of a standard bed pillow. It is also contemplated that the body 21 and casing 28 be supported on a hang card 30 with a transparent blister-pack attachment 32 securing the body and casing in place. Of course, when it is desired to use the insert 20, it is removed from the packaging 30,32, and the initial body 21 is removed from the casing 28 (as illustrated in FIG. 2). Those ordinarily skilled in the art will appreciate, however, that such packaging is not required and multiple shoe inserts may alternatively be provided (instead of just one).

The body 21 preferably comprises (and more preferably consists essentially of) memory foam material. Most preferably, the memory foam is a heat-sensitive, viscoelastic, closed-cell polyurethane material, operable to react to body heat and mold itself to a body part shape. Advantageously, the memory foam should have a density of from about one to five pounds and, more preferably, about three pounds, using industry standards for such foam densities.

FIGS. 6-7 depict the use of shoe insert 20 in forming a resilient shoe insert body 22. Specifically, the shoe 34 in this case is a standard woman's high-heeled shoe (e.g., with a heel having a height of at least about one and one-half inches) having a sole 35 and a shoe upper 36. The sole 35 and upper 36 cooperatively present a substantially pointed and enclosed forward toe region 37. It is particularly noted that the toe region 37 presents a cross-sectional dimension (defined by the sole 35 along a lower margin and the upper 36 along the top and side margins), which tapers distally. As will be apparent, this shoe design is relatively standard and, more specifically, provides an area of the toe region which is typically "unoccupied" by the toes of the wearer. Furthermore, the toes are often caused to conform to the distally tapering configuration of the toe region 37, particularly when the shoe has a high heel (which causes the foot to be forced distally within the shoe).

In use with the shoe 34, the original quadrate body 21 is cut diagonally along line 38 (see FIG. 5) to yield the insert body 22 (see FIGS. 6 and 7). It is particularly noted that the insert body 22 has a shape generally corresponding to a portion of the toe region 37. This portion preferably consists of slightly more than "unoccupied" part of toe region 37 so that insert body 22 is engaged by the toes without crowding the toes or requiring significant compression of the body 22. It is also noted that the toe region has a proximal boundary that terminates around the ball of the wearer's foot, and the insert body 22 is spaced distally from the proximal boundary of the toe region 37 when in use. More specifically, the insert body 22 has a proximal (or rearmost) toe-engaging surface 40, which corresponds with the bisectional line (or cut line) of the original quadrate body 21 in the preferred embodiment. The illustrated toe-engaging surface 40 is substantially flat, although other suitable shapes (e.g., curved, grooved to conform more closely to the shape of the toes, etc.) are entirely within the ambit of the present invention. Moreover, the toe-engaging surface 40 spans the corresponding cross-sectional dimension of the toe region 37. In other words, the insert body 22 is preferably dimensioned and configured so that the toe-engaging surface is generally coextensive with the cross-sectional dimension of the toe region 37, with the body 22 being in substantially continuous contact (or at least close proximity) with the sole 35 and upper 36. Furthermore, the preferred toe-engaging surface 40 is angled to project proximally more along the laterally outer margin of the shoe, which ensures contact with the smaller toes of the wearer.

It will be appreciated that the body 20 may be cut with manual scissors or through the use of a utility knife or other suitable means. Furthermore, certain aspects of the present invention encompass a shoe insert comprising an insert body that is already dimensioned for use, so that no cutting or sizing by the user is required. In any case, the insert body 22 is inserted within shoe 34 and pressed forwardly as indicated by arrow 42 (FIG. 6) so that a corner apex 44 of the body 22 is positioned in close conforming relationship to the forward extent of toe region 37. The resilient and pliable nature of the memory foam material making up the insert 22 allows the latter to closely conform with the toe region, as illustrated in FIG. 7.

When the wearer dons shoe 34, the toes 46 of the wearer come into direct abutting contact with the toe-engaging surface 40 of body 22. The normal body temperature of the wearer, together with the sustained forces imposed on insert 22, cause the latter to closely conform with the wearer's toes, as illustrated by the undulating shape 48 assumed by the surface 40. It will be observed in this respect that the rear surface 40 of the insert 22 is substantially within the toe region 37 and in any case does not extend to a point where contact is made with the ball of the user's foot. In preferred forms, substantially the entirety of the insert 22 is positioned forwardly of the wearer's toes 46, and does not extend beneath the toes.

Figure 8:
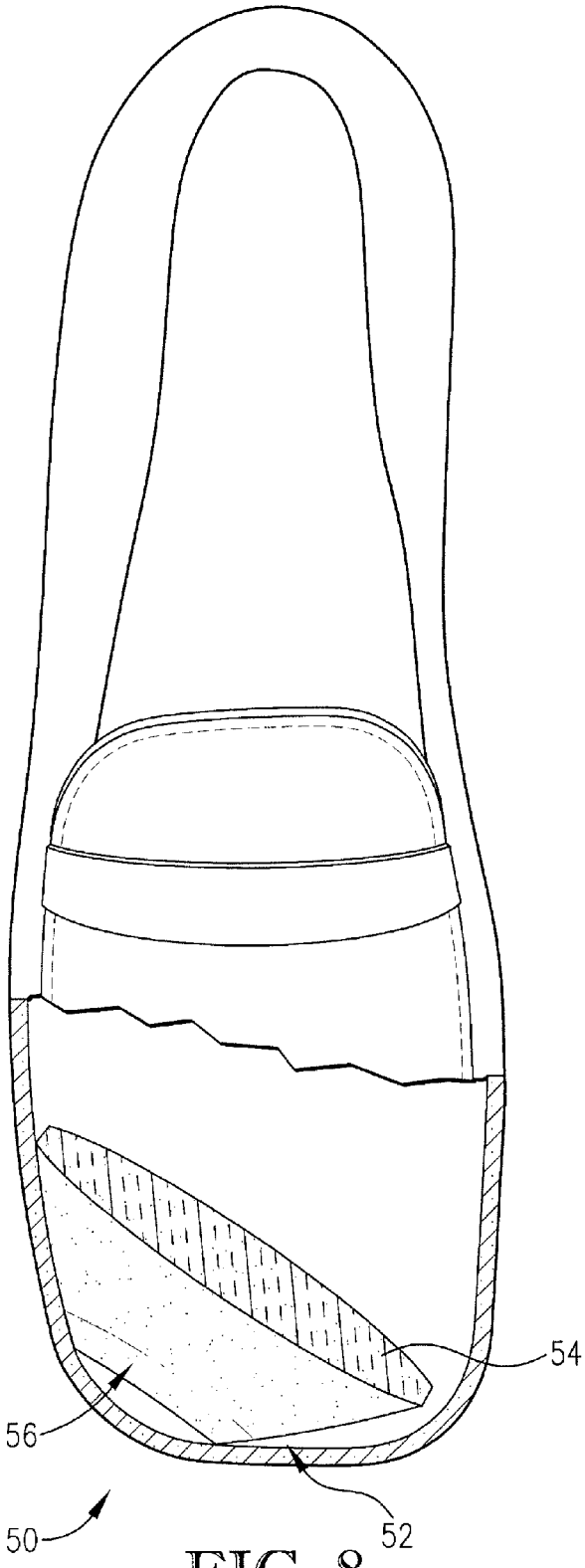
FIG. 8 is a top view and partial vertical section of a different type of shoe, with a pre-cut and shaped insert located with the toe region of the shoe.
Figure 9:
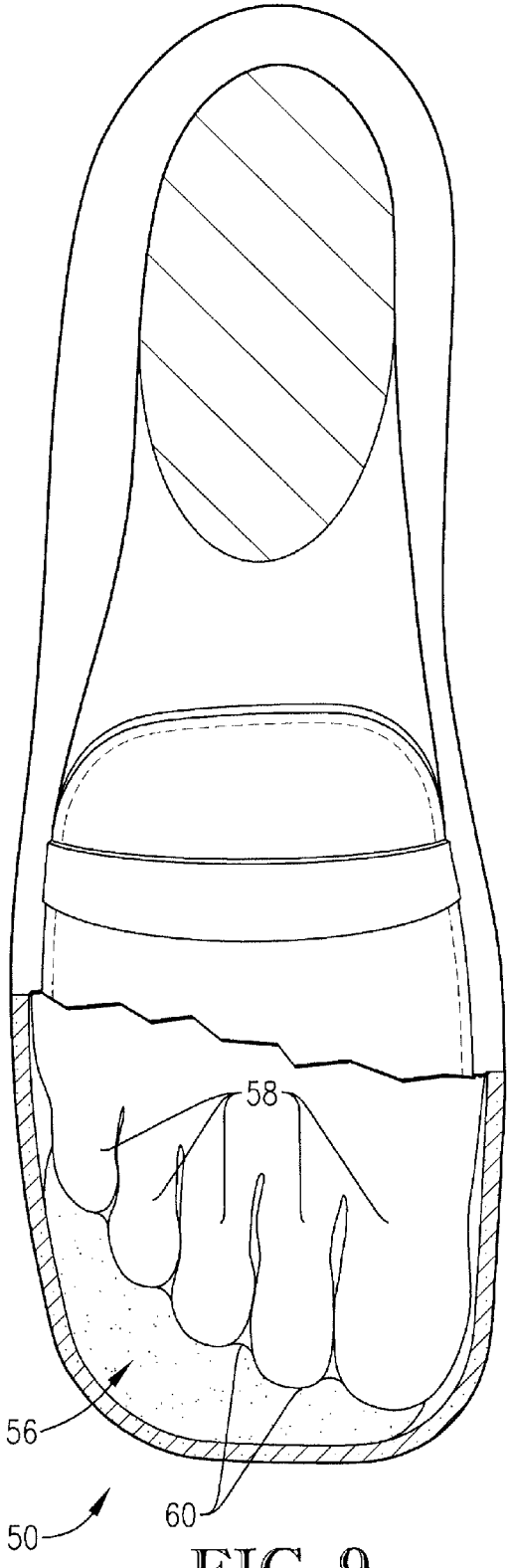
FIG. 9 is a view similar to that of FIG. 8, but showing the insert during use thereof, while the shoe is worn.

FIGS. 8-9 illustrate another type of shoe 50, in this case a man's slip-on shoe having a substantially blunt or flattened toe region 52. In such a situation, the original quadrate body 20 is cut to present a flattened proximal (or rear) surface 54, thereby giving an shoe insert 56 optimally designed for the shoe 50. As illustrated, the insert 56 and surface 54 are aligned with the natural placement of the wearer's toes 58 when the shoe 50 is donned. Again, over a short period of time after donning, the surface 54 assumes an undulating configuration 60 in close conforming relationship with the forward extent of the wearer's toes.

A principal aim of the invention is to provide increased comfort during shoe wear, by providing an improved viscoelastic shoe toe insert. For example, some activities involve use of "undersized" shoes and the insert can be used to provide comfort in these extreme conditions. One such example involves ski boots worn by competitive or performance skiers. Skiers will often wear ski boots that are as much as several sizes smaller than their normal size, and the insert will facilitate comfort of the toes during use.

Figure 10:
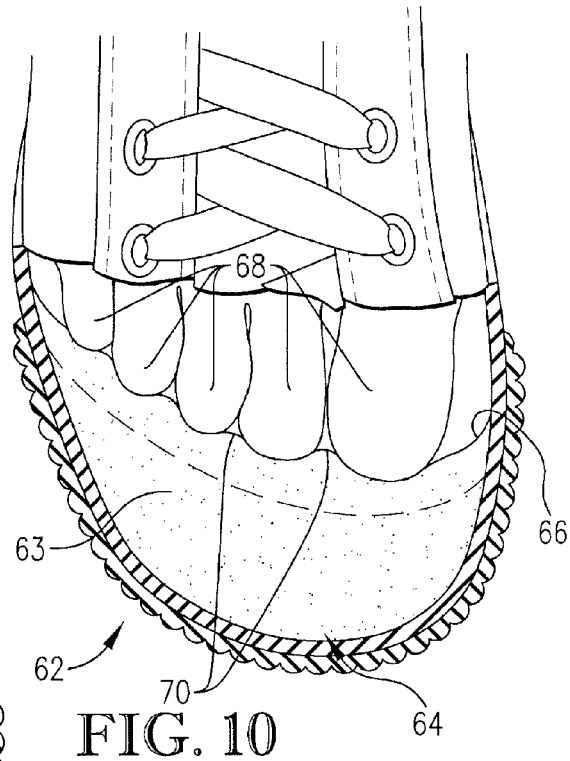
FIG. 10 is a view in partial vertical section of an oversized shoe for a growing child, with an insert body having its original pre-cut dimensions when the shoe if first worn by the child.
Figure 11:
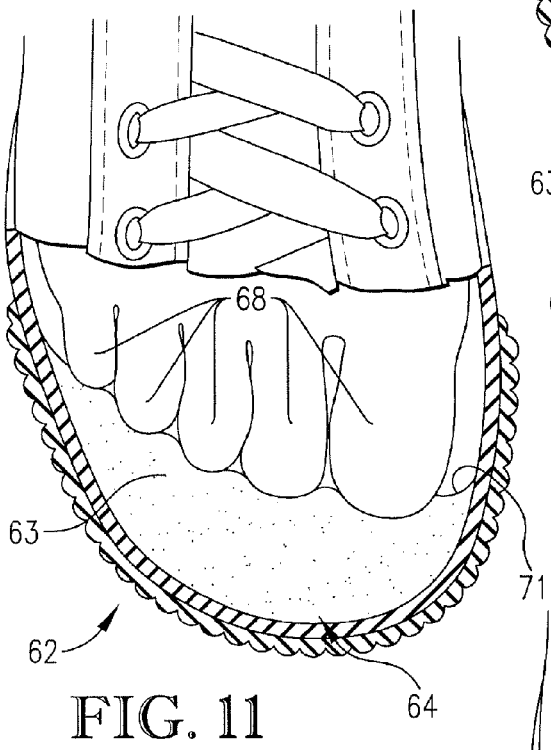
FIG. 11 is a view similar to that of FIG. 10, but showing the child's foot after some growth and the insert body having been cut to a smaller size to accommodate such growth.
Figure 12:
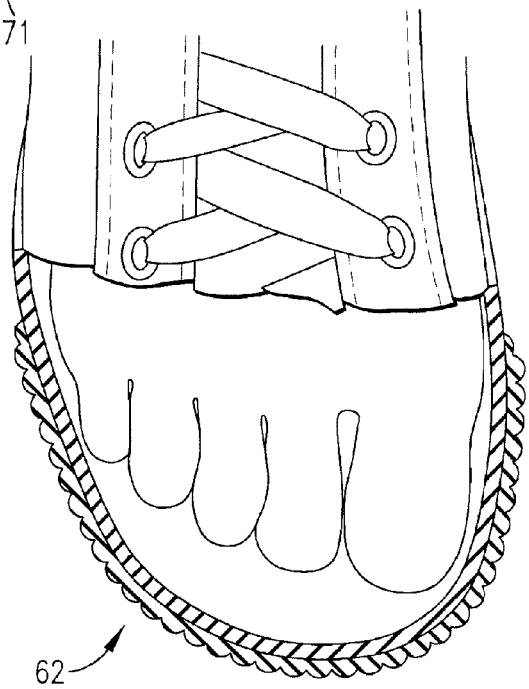
FIG. 12 is a view similar to that of FIGS. 10 and 11, showing the shoe without the insert after the wearer has grown into the initially oversized shoe.

Another preferred embodiment of the present invention is depicted in FIGS. 10-12. In particular, children's shoes are often purchased one to two sizes too large so that the child is permitted to "grow" into the shoe. As depicted, the child's shoe 62 is initially oversized by a size or two (see FIG. 10). The original quadrate body 21 is cut to provide the shoe insert body 63 conforming with the rounded toe region 64 of the shoe 62 (which may require multiple cuts). In this embodiment, the insert body 63 has a rearmost arcuate toe-engaging surface 66 best seen in FIG. 10, which is engaged by the wearer's toes 68 when the shoe 62 is donned. Thereafter, the surface 66 assumes the undulate shape 70 in close conforming relationship with the forward surfaces of the user's toes 68. As the user grows into the shoe 62, the insert 63 may be resized, which preferably involves removing and trimming the insert body 63 to a new smaller size as depicted in FIG. 11. Trimming of the insert body 63 is preferably accomplished by cutting the body 63 along its proximal margin so that a proximal portion is removed and a new toe-engaging surface 71 is defined. Furthermore, once the child has grown into the shoe 62, the insert body 63 can be completely removed and the shoe may be conventionally worn (FIG. 12). Thus, the insert of the invention allows a youth to comfortably wear what would normally be considered oversized shoes, until the youth grows into the shoes.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states her intent to rely on the Doctrine of Equivalents to determine and assess the reasonably fair scope of the present invention as pertains to any apparatus not materially departing from but outside the literal scope of the invention as set forth in the following claims.

What is claimed is:

1. A shoe insert consisting of:

a body formed of a compressible material, said body presenting a substantially rectangular plan configuration, said body having a generally bulbous mid-section with lower and upper surfaces that are generally arcuate, said body being severable along a generally diagonal cut line from a first corner to an opposing second corner to present two insert bodies, each insert body adapted to be placed within a toe region of a shoe and including— a substantially flat surface corresponding to the diagonal cut line for engagement by toes of a wearer of the shoe, and a corner apex positioned opposite the surface and adapted to be placed in the forward-most area of the toe region.

2. A shoe insert consisting of:

a body formed of a compressible material, said body presenting a substantially rectangular plan configuration, said body having a generally bulbous mid-section with lower and upper surfaces that are generally arcuate, said body being severable along a generally bisectional cut line from a first side to an opposing second side to present two insert bodies, each insert body adapted to be placed within a toe region of a shoe, wherein said first side of each said insert body has a substantially flat surface corresponding to the bisectional cut line for engagement by toes of a wearer of the shoe, and wherein said second side of each said insert body, which is opposite said first side, is adapted to be placed in the forward-most area of the toe region.

* * * * *